US007775292B1

(12) United States Patent
Romanco

(10) Patent No.: US 7,775,292 B1
(45) Date of Patent: Aug. 17, 2010

(54) CO2 FIRE SUPPRESSION MONITORING APPARATUS AND METHOD

(76) Inventor: Ernest K. Romanco, 661 N. Concord Rd., Albion, MI (US) 49224

( * ) Notice: Subject to any disclaimer, the term of this patent is extended or adjusted under 35 U.S.C. 154(b) by 1107 days.

(21) Appl. No.: 10/898,883

(22) Filed: Jul. 26, 2004

(51) Int. Cl.
*A62C 35/00* (2006.01)
*A62C 35/02* (2006.01)

(52) U.S. Cl. ..... 169/9; 169/6; 169/16; 169/20; 169/27

(58) Field of Classification Search ..... 169/60, 169/61, 65, 70; 340/517, 521, 577, 578, 340/632
See application file for complete search history.

(56) References Cited

U.S. PATENT DOCUMENTS 4,616,694 A * 10/1986 Hsieh ..... 165/47
5,053,754 A * 10/1991 Wong ..... 340/632
5,079,422 A 1/1992 Wong
5,691,704 A * 11/1997 Wong ..... 340/628
5,910,765 A * 6/1999 Slemon et al. ..... 340/517
5,936,531 A * 8/1999 Powers ..... 340/628
5,950,150 A * 9/1999 Lloyd et al. ..... 702/183
6,866,102 B2 * 3/2005 Boyce et al. ..... 169/61
7,142,105 B2 * 11/2006 Chen ..... 340/521
7,174,769 B2 * 2/2007 McSheffrey et al. ..... 73/37

* cited by examiner

*Primary Examiner*—Len Tran
*Assistant Examiner*—James S Hogan
(74) *Attorney, Agent, or Firm*—Northern Michigan Patent Law, PLC

(57) ABSTRACT

A monitor apparatus and method for monitoring, verifying, and prompting an existing CO2 type fire suppression system in a room or building protected by the suppression system. In its most preferred form the monitor apparatus is a unit contained in a cabinet or housing placed in the protected room, with only a signal connection to the suppression system. The monitor apparatus has a suppressant gas concentration sensor enabled by a discharge signal received from the suppression system, and a datalogger to keep a verifiable record of the suppression system's discharge performance. The monitor unit sends a continue-discharge signal back to the suppression system independently of the continuity of the suppression system's discharge signal if a desired gas concentration level in the room is not reached or held per the suppression system's own requirements.

21 Claims, 8 Drawing Sheets

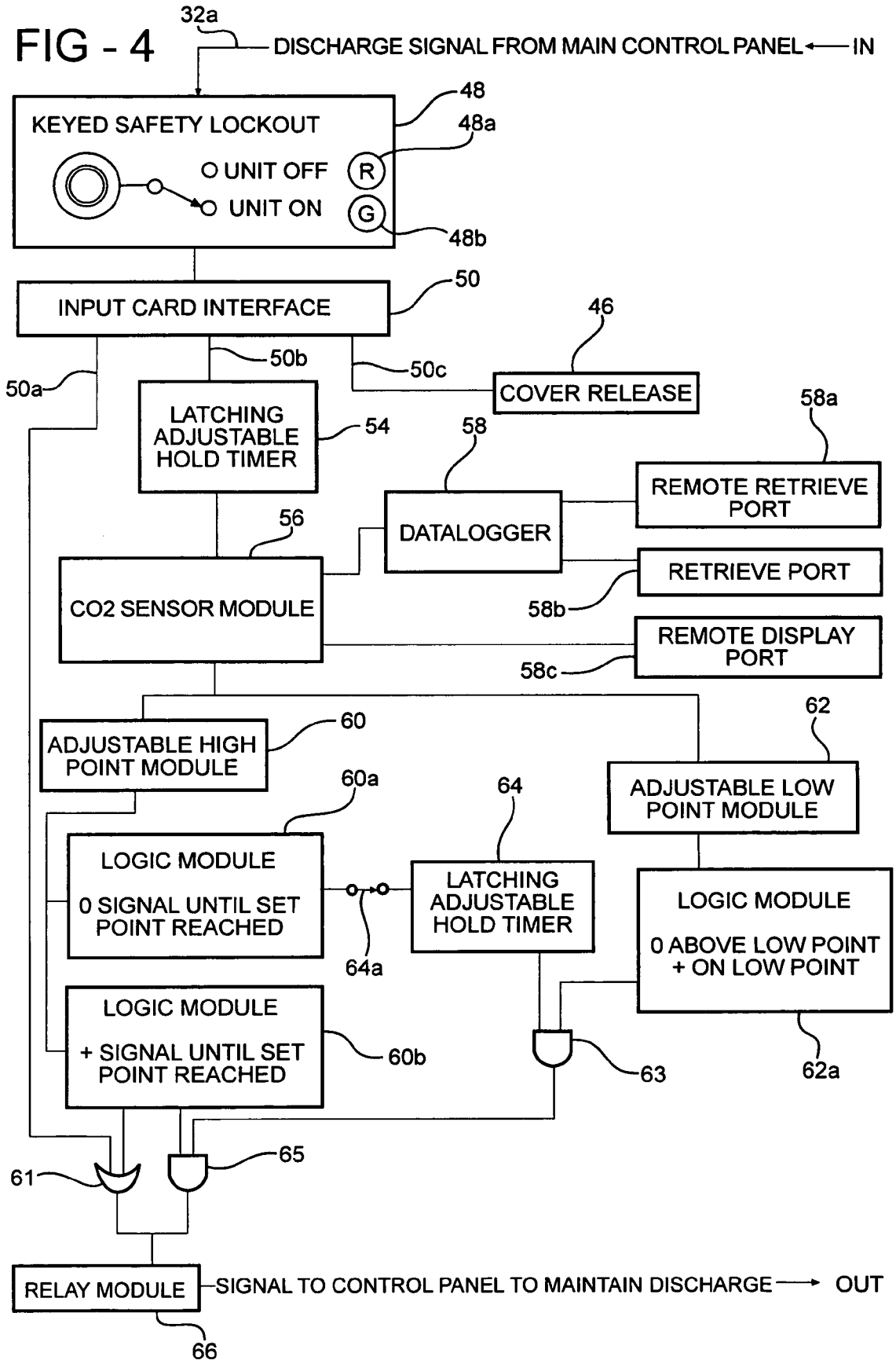
FIG - 4
32a
DISCHARGE SIGNAL FROM MAIN CONTROL PANEL
IN
KEYED SAFETY LOCKOUT
48
48a
UNIT OFF
UNIT ON
R
G
48b
INPUT CARD INTERFACE
50
46
50a
50b
50c
COVER RELEASE
LATCHING ADJUSTABLE HOLD TIMER
54
58
58a
REMOTE RETRIEVE PORT
DATALOGGER
56
RETRIEVE PORT
CO2 SENSOR MODULE
58b
REMOTE DISPLAY PORT
58c
ADJUSTABLE HIGH POINT MODULE
60
62
ADJUSTABLE LOW POINT MODULE
60a
64
LOGIC MODULE
0 SIGNAL UNTIL SET POINT REACHED
LATCHING ADJUSTABLE HOLD TIMER
LOGIC MODULE
0 ABOVE LOW POINT + ON LOW POINT
64a
LOGIC MODULE
+ SIGNAL UNTIL SET POINT REACHED
60b
63
62a
61
65
RELAY MODULE
SIGNAL TO CONTROL PANEL TO MAINTAIN DISCHARGE
OUT
66

CO2 FIRE SUPPRESSION MONITORING APPARATUS AND METHOD

FIELD OF THE INVENTION

The present invention is in the field of automatic CO2-type fire suppression systems used in enclosed commercial and industrial environments.

BACKGROUND OF THE INVENTION

Businesses, industrial plants, nuclear and conventional power plants, warehouses, stores and similar places with records, equipment, fixtures, and inventory often need automated fire protection to suppress fire. CO2-type fire suppression systems are common, with suppressant gas discharge tanks stored on or adjacent the premises, connected by piping to discharge nozzles stationed around an enclosed area (room, wing, building) to be protected. A central detection and control panel monitors an array of fire/smoke/heat sensors located in the area being protected, and sends a discharge signal to discharge CO2 from the storage tanks when a fire is sensed. In the case of occupied environments, the discharge signal is delayed for a short period of time after a fire is sensed, for example with a programmed delay where the suppressant gas is stored in high pressure cylinders in or near the room, or with an inherent delay where the suppressant gas is stored in remote, low pressure bulk cylinders and takes time to reach the discharge nozzles. During the delay the room is cleared of people with an alarm such as a horn.

A simplified example of a CO2 type fire suppression system 10 is shown schematically in FIG. 1, in which a room 12 is provided with fire detectors 14 connected to a controller 16 to signal the start of a fire. Controller 16 can be any known type of controller, usually taking the form of (and referred to as) a control panel. Control panel 16 is connected in known manner at 17 to the control valving 18*a* for a bank of suppressant gas storage tanks 18, which may be any known type of high pressure cylinders or low volume bulk tanks or combinations thereof. Tanks 18 are connected by piping 20 to an array of discharge nozzles 22 located about the interior of room 12. When control panel 16 receives a signal from detectors 14 that a fire has started, the control panel sends a discharge signal to open discharge valving 18*a*, thereby releasing pressurized suppressant gas from tanks 18 into the room to suppress the fire by oxygen displacement. The suppressant gas may also provide an optional cooling effect, depending on the gas and the discharge valving. The typical discharge cycle carried out by control panel 16 is an initial discharge (for example one minute) in which the system should achieve a desired suppressant gas concentration level calculated to extinguish the fire, followed by a longer hold time (for example twenty minutes) during which the concentration should be maintained to make sure the fire is out and will not start again.

Fire suppression systems should be tested periodically to ensure that that they will function properly in a real fire. Beyond basic nozzle function, the ability of a system to reach and hold desired CO2 concentrations in the protected area is critical. Unfortunately, most such systems are not tested, or are inadequately tested, for a number of reasons.

The proper way to test an automated, large-area fire suppression system for reach-and-hold CO2 concentration ability is to carry out a full-discharge test. This involves shutting down the facility, bringing in specialists with portable discharge concentration monitors, clearing the facility of people, discharging the storage tanks of CO2, ventilating the facility, and going back in (often with self-contained breathing apparatus) to check the monitors. The facility owners are often reluctant to go through this procedure because of the downtime, specialist fees, and perceived cost of recharging the bulk storage tanks with CO2. Many fire suppression systems are accordingly never properly tested, the owners usually relying on theoretical specifications or limited nozzle function tests. To make matters worse, the system specifications are often marginally written to keep costs and CO2 storage space down, and the site-built nature of the systems often involves non-specialist contract labor not experienced with fire suppression and CO2 discharge issues.

If a fire does occur, it is also difficult to determine whether the suppression system actually worked, creating insurance issues. Insurance people are generally believed to have limited knowledge of CO2 type fire suppression, and of what makes for a proper system or a proper testing and maintenance program. The insurance people accordingly tend to rely on the marginal installer specifications, which can create problems both for the system's performance in a fire and in insurance evaluations afterward.

BRIEF SUMMARY OF THE INVENTION

The invention is a stand-alone apparatus that complements an existing CO2-type fire suppression system by independently monitoring and verifying system performance, both during testing and actual fires, and by providing a prompt signal to the suppression system to maintain CO2 discharge until desired concentrations are reached and held. The invention also includes the method carried out by the apparatus. CO2-based suppression systems are the preferred systems complemented by the invention, because the well-developed state of CO2 sensors (for applications such as greenhouse monitoring, air quality measurement, medical monitoring, and industrial process control) allows a direct measurement of suppressant gas concentration, but the invention can be used with any suppressant gas system whose function can be monitored directly with concentration sensors, or indirectly with oxygen depletion sensors.

In its preferred form the invention is a stand-alone "box" or monitor unit whose only required connection to a fire suppression system is a signal connection to the system control panel. The monitor unit includes its own suppressant gas concentration sensor, for example a CO2 concentration sensor, or an oxygen-depletion sensor where an indirect measurement of the suppressant gas concentration is desired. The monitor unit is activated by the discharge signal from the main control panel of the existing fire suppression system. In a preferred form the monitor unit has a sealed enclosure with an automatically opening cover to expose the concentration sensor to the suppressed environment. The unit has a data logging mechanism associated with the sensor to record suppressant gas concentrations, and a "continue discharge" signal output connected to the suppression system control panel to maintain gas discharge until the concentration sensor indicates that the target concentration has been reached in the vicinity of the monitor unit.

In a preferred form the monitor unit includes a logic circuit and at least one latching type timer responsive to the monitor unit's own concentration sensor, maintaining the continue-discharge signal until concentration is reached and then monitoring the need for continued or additional discharge during the suppression system's hold period, independently of the signal from the suppression system control panel. In a most preferred form the monitor unit includes two hold timers, the first timer latching the concentration sensor and the data logger "on" to match or exceed the suppression system's programmed discharge and hold times, the second timer being activated by the concentration sensor to ensure that a continue-discharge signal is sent to the suppression system when needed.

In a further preferred form the monitor unit is housed in a cabinet with a fall-away panel or cover that exposes the sensors when the unit is activated. The cover is preferably clear to allow unit indicator lights to be viewed when the cover is closed.

The monitor unit is not part of the existing fire suppression control system, and has no effect on the suppression system other than to prompt the control panel to continue discharging the storage tanks, and to provide an independent record of the suppression system's performance over the course of a fire. While the concentration sensor and the remainder of the monitor unit are preferably integrated in a single housing placed in the protected environment, the concentration sensor can also be located in the protected environment remotely from the monitor unit circuitry to which it is connected. The monitor unit is preferably physically separate from the suppression system's control panel, but with the exception of the monitor unit's concentration sensor could be integrated into the control panel.

These and other features and advantages of the invention will become apparent upon further reading of the specification, in light of the accompanying drawings.

BRIEF DESCRIPTION OF THE DRAWINGS

FIG. 4 is a schematic circuit of the components of the monitor unit of FIGS. 2 and 3.

DETAILED DESCRIPTION OF THE INVENTION

Figure 1:
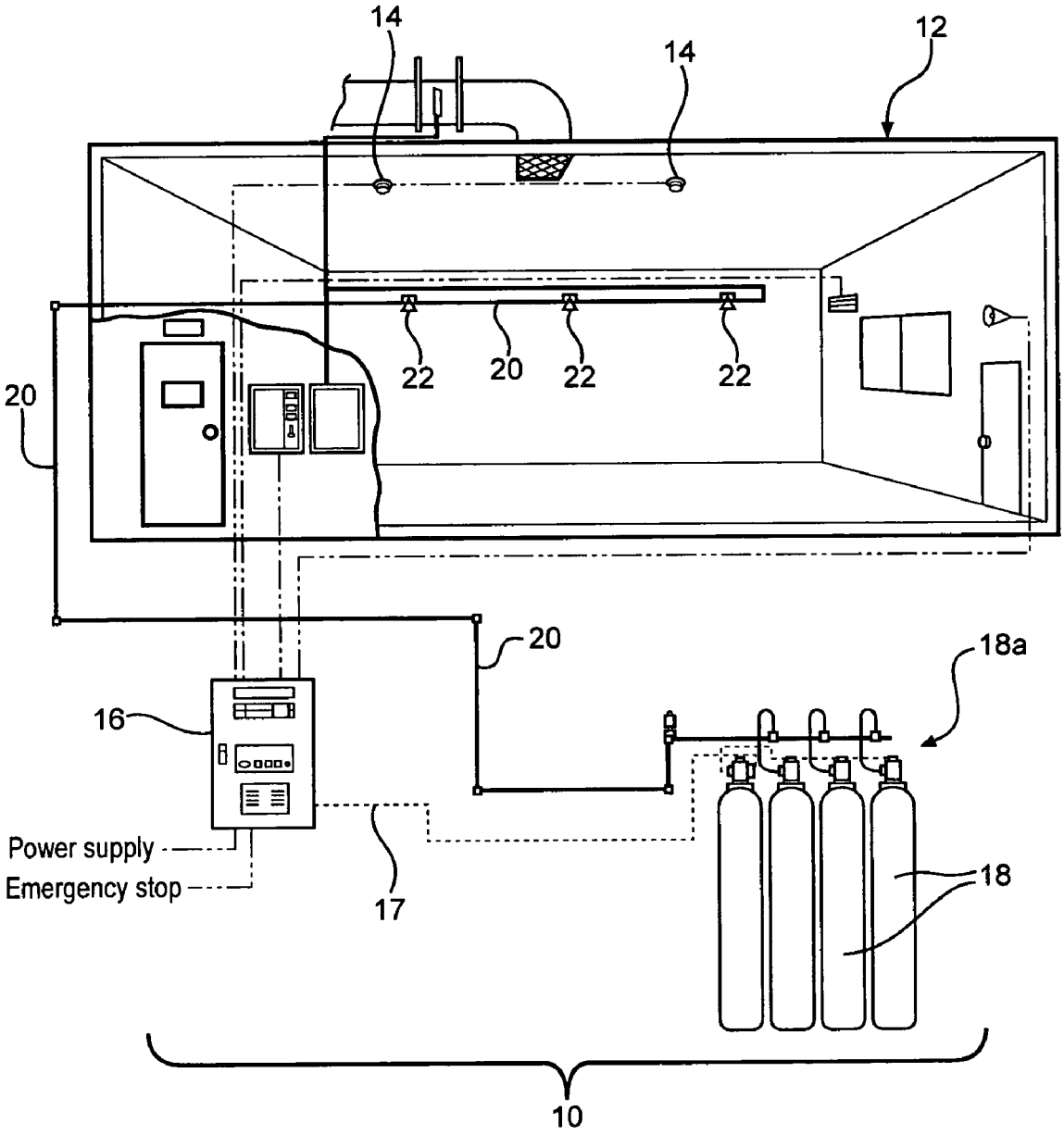
FIG - 1 PRIOR ART
FIG. 1 is a schematically illustrated prior art fire suppression system of the type with which the present invention is useful.
Figure 2:
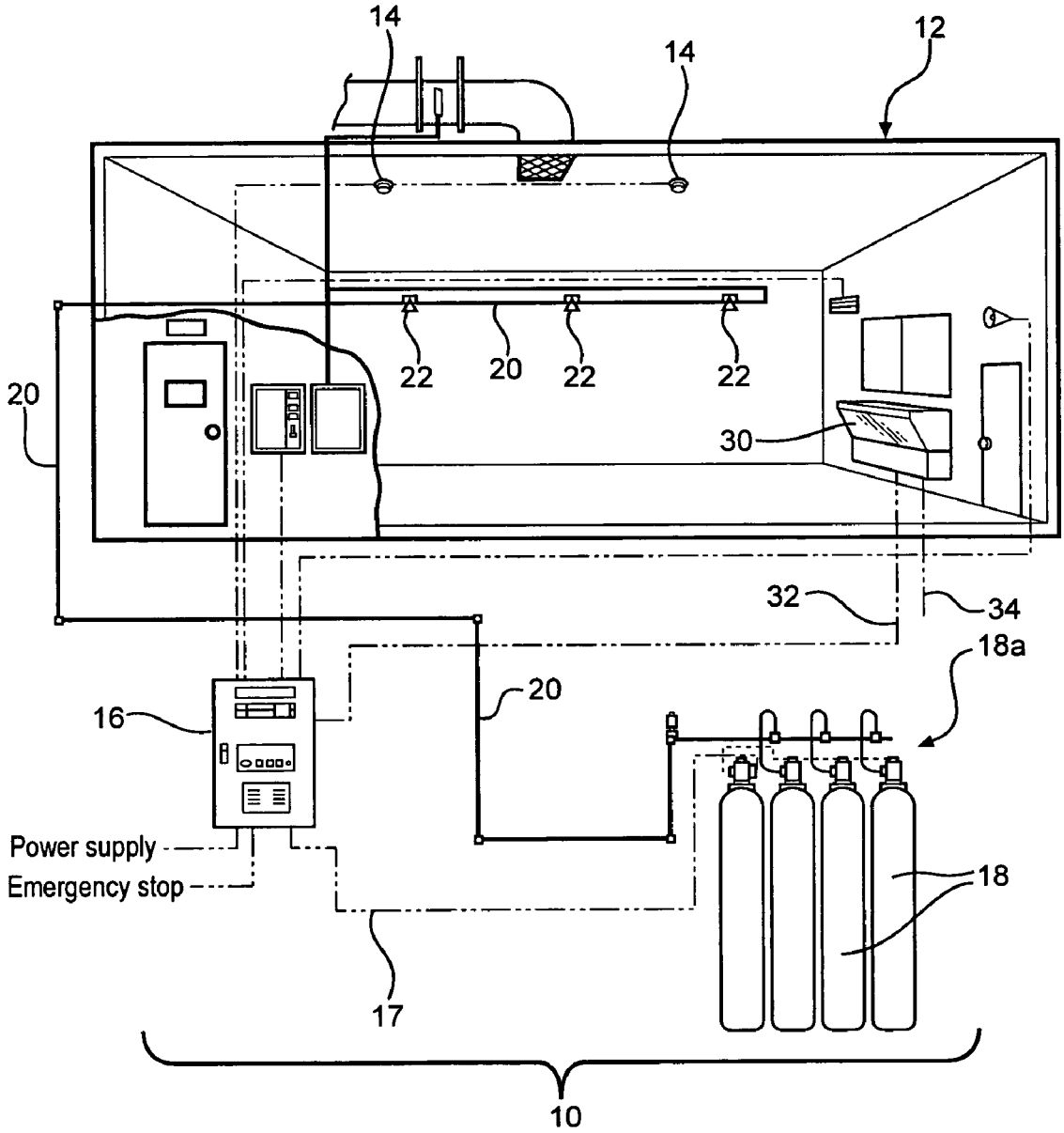
FIG. 2 is similar to FIG. 1, but shows a monitor unit according to a most preferred embodiment of the invention stationed in the protected room and connected to the control panel.
Figure 3:
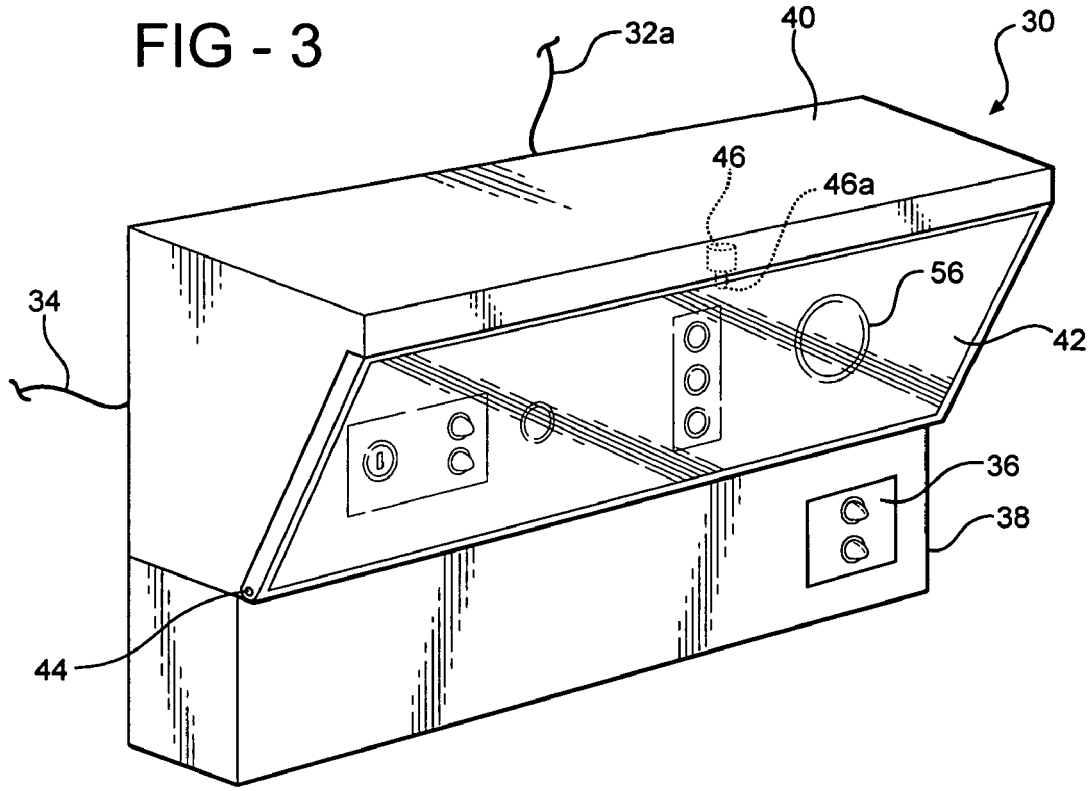
FIG. 3 is a perspective view of a preferred form of a monitor unit according to the invention, in particular its outer housing or cabinet.

Referring first to FIGS. 2 and 3, the invention is illustrated in a preferred example in which room 12 protected by existing fire suppression system 10 is provided with at least one monitor unit 30 with a two-way signal connection 32 to control panel 16. It will be understood that "room" 12 can be an enclosed area of any size or shape capable of being protected by a fire suppression system of the type generally represented by system 10. Monitor 30 is a "stand-alone" unit in the sense that it is contained in its own housing or cabinet 40, and its only connection to fire suppression system 10 is the signal connection 32, which is preferably a fire-resistant connection such as a hardened cable 32*a* or a wireless communication link. Power for monitor 30 can be supplied independently of the fire suppression system, in a preferred form with an external primary source from a cable connection 34, and a self-contained battery backup such as a UPS (uninterruptible power supply) 36 contained in a base or separate cabinet 38.

Monitor unit 30 is activated by a "discharge" signal from main control panel 16, preferably the same signal that activates storage tanks 18 to release the suppressant gas into room 12. Monitor unit 30 has a gas concentration sensor 56 whose air-sampling face 56*a* is normally kept under a protective cover 42 (FIG. 3). Cover 42 in the illustrated embodiment makes a dustproof seal around sensor 56 to keep it free from dust and false triggers during the monitor's passive mode, and may be lockable to discourage unauthorized access. Cover 42 in the example of FIG. 3 is hinged at 44 along its inwardly-angled lower edge, and latched at 46 along its upper edge, and has sufficient weight to fall freely open when latch 46 is released. Cover 42 is preferably made from a transparent material, for example tempered glass or Lexan plastic, allowing a clear view of the operator panel 47 underneath, and has sufficient weight to overcome any tendency to "stick" against any gasket or seal surface provided on the face of the monitor cabinet. Illustrated latch 46 is a solenoid latch with a pin 46*a* that normally engages a socket or bracket in the upper edge of cover 42, the pin being retracted when the latch is activated by the signal from the control panel. The latching mechanism is preferably supplemented with a manual release, for example a manual release feature built into the solenoid latch 46 in known manner. It will be understood that many known types of automatically releasable latch mechanism can be used, and the example of solenoid 46 is merely illustrative.

Figure 3A:
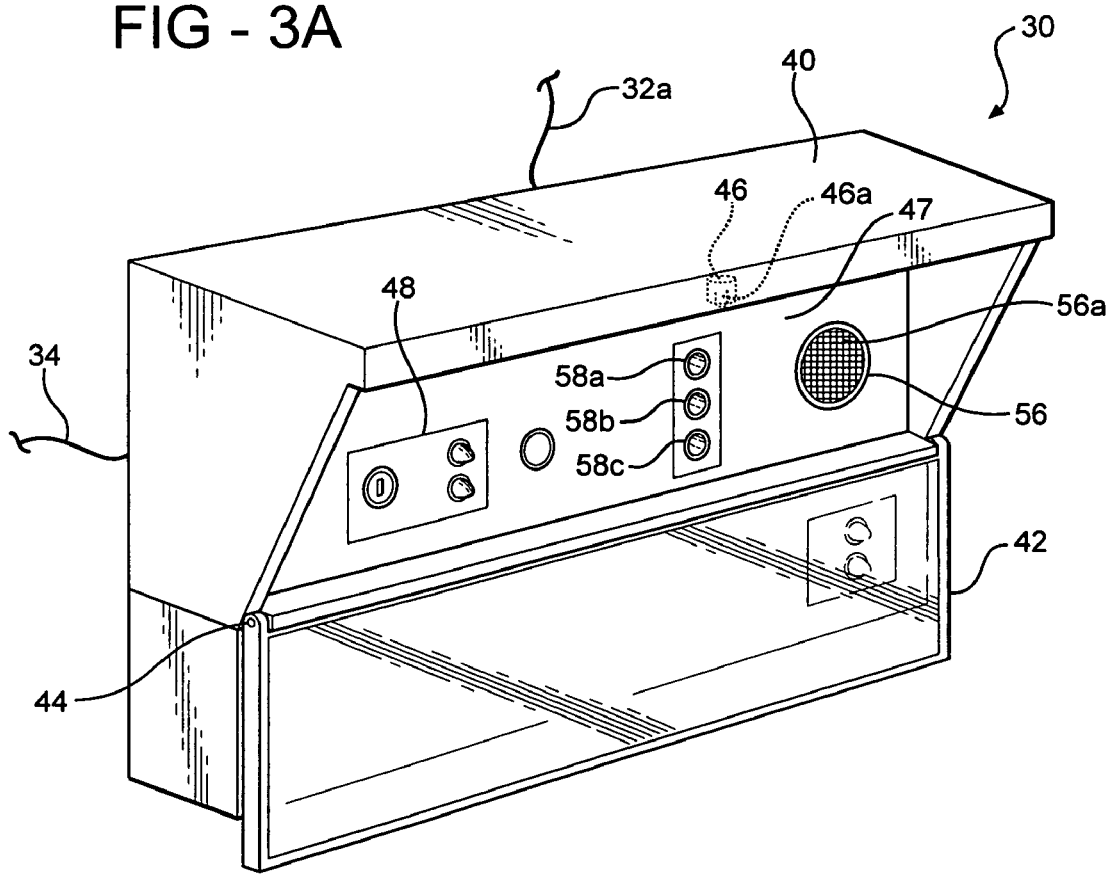
FIG. 3A is similar to FIG. 3, but shows an automatically-opening cover having dropped away from an interior portion of the cabinet to expose a concentration sensor to the atmosphere of the room.
Figure 3B:
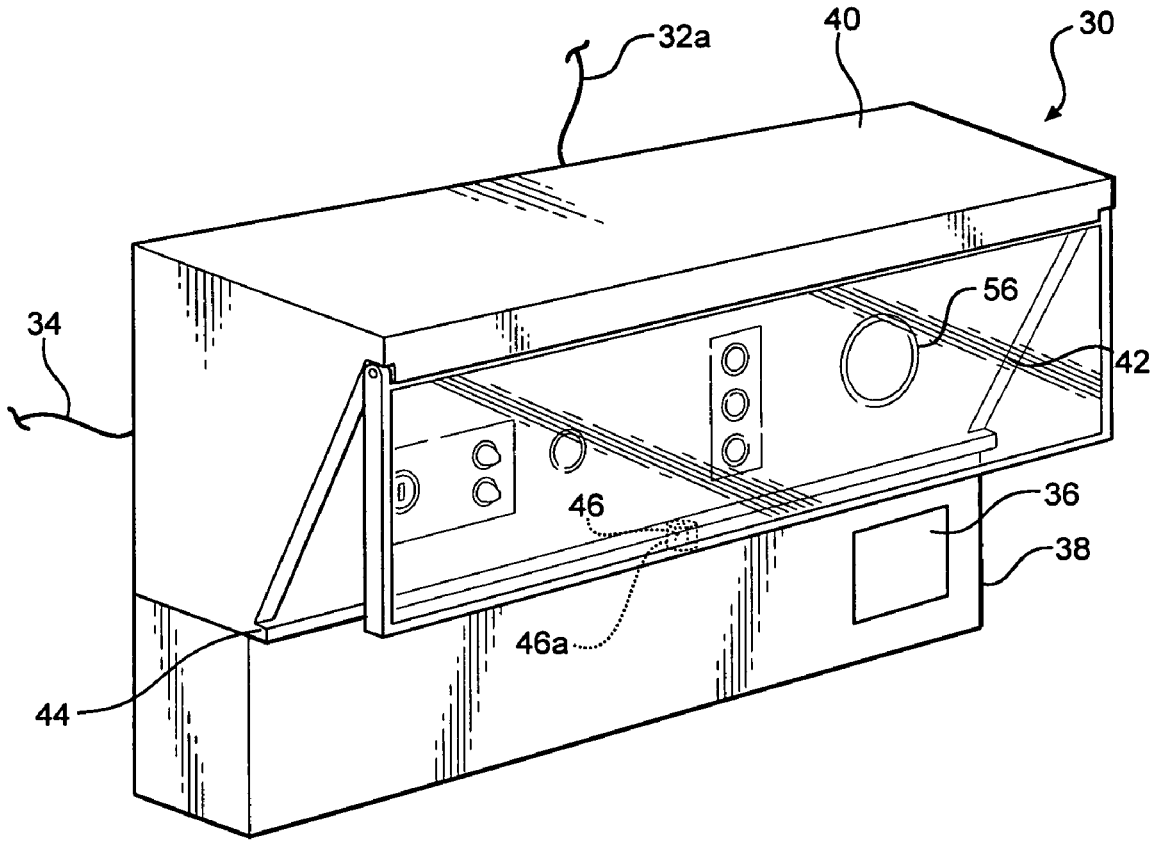
FIG. 3B is similar to FIG. 3, but shows an alternate gravity-opening cover arrangement.

FIG. 3A shows cover 42 open to the atmosphere of room 12, having fallen away from cabinet 40 when latch 46 was released. FIG. 3B shows an alternate gravity-opening cover arrangement, in which cover 42' is hinged at its upper edge and releasably latched at its bottom edge. It will be understood that while gravity-opening action is currently preferred for the sensor cover on monitor 30, other forms of opening mechanism can be employed, including actively-powered mechanisms such as motor drives, and active assist mechanisms to supplement a passive opening mechanism like the gravity-operated hinged cover 42. Hinged covers, sliding covers, rotating covers, and other forms of automatically opening sensor cover can be used and the possible variations will be readily understood by those skilled in the art.

Monitor cabinet 40 can be made from many different materials such as metals and/or certain polymers suitably resistant to the high temperatures of a fire. Depending on the room or area being protected by the fire suppression system, cabinet 40 may need to be explosion-proof. Monitor cabinet 40 and cover 42 are also preferably tamper- and vandal-resistant. Cabinets or housings with the foregoing qualities can be readily manufactured by those skilled in the art.

FIG. 4 illustrates a currently preferred logic circuit and component layout for monitor 30, illustrated schematically since the individual components are commercially available in different forms and versions, may be replaceable in some cases with functional equivalents, and since the manner of programming, setting, and/or connecting them in the illustrated arrangement will be readily apparent to those skilled in the art. For example, most or all of the individual components illustrated can be purchased or made individually and connected as shown on a circuit board, or can be found in integrated forms in which multiple components are contained in a single device or on a single board that can be configured to operate as described. It may even be possible to replace some of the components of FIG. 4 with software in a computer or controller mechanism.

The keyed safety lockout panel 48 the sampling face of sensor 56, and any output ports or indicator lights are the only components shown in FIG. 4 that are visible to an operator, the remainder of FIG. 4 being sealed behind operator panel 47 in the cabinet example of FIG. 3. Lockout panel 48 allows monitor unit 30 to be shut off, for example when people are present in room 12 to prevent triggering of the monitor's continue-discharge signal, or for maintenance. Indicators such as LEDs 48*a* and 48*b* give a visual indication of the monitor's status through clear cover 42.

When the monitor unit is turned "on" via panel 48, an input interface card 50 is connected to and monitors signal connection 32*a* for the "discharge" signal from the fire suppression system control panel 16. Input card interface 50 can be an analog, digital, or optical input/output card (or equivalent) of known type, depending on the existing fire suppression system and the environment where the monitor unit will be used. When a discharge signal is received, interface 50 sends a signal through output 50*c* to activate cover release mechanism 46 (the solenoid 46 in FIGS. 3, 3A, and 3B). The interface card 50 is connected through another output 50*a* through a relay module 66 to the suppression system control panel, effectively looping the discharge signal back to the control panel, except that the "continue discharge" signal from relay module 66 is preferably a prompt to the control panel to maintain or renew its own original "discharge" signal.

Interface 50 is also connected through an output 50*b* to trigger a suppressant gas concentration sensor module 56 and datalogger 58, in response to the "discharge" signal from the main system control panel, through a hold timer 54. Hold timer 54 begins counting down a time period (for example twenty-one minutes) matching or exceeding the sum of the suppression system's initial discharge time (for example one minute) and hold time (for example twenty minutes) programmed into control panel 16. Hold timer 54 is preferably adjustable to permit it to be matched to different control panels and fire suppression systems, and to overlap the control panel's hold time to ensure that no data are missed. During this time period, concentration sensor 56 and datalogger 58 are latched "on" by timer 54.

Concentration sensor module 56 is preferably kept at half power to prolong sensor life during the months or years between testing or fires, and for a fast warm-up when the discharge signal is received. A wide variety of commercially available sensors can be used, as will be recognized by those skilled in the art, and can be selected on the basis of their operating ranges relative to the desired suppressant gas concentration (for example, 35% for a CO2 based system).

Concentration sensor module 56 is connected to datalogger 58, which simultaneously begins recording concentration readings (for example in the form of analog voltage signals) from the sensor module 56, preferably correlated to the elapsed time signal from timer 54. This provides a record for later evaluation of the rate at which suppressant gas concentration levels were achieved in the vicinity of the monitor during the initial discharge period (for example one minute) and the hold period (for example twenty minutes) over the course of a test or a fire. Suitable dataloggers and equivalent data recording devices are commercially available and well known to those skilled in the art. In the illustrated embodiment datalogger 58 includes both remote and direct retrieve ports 58*a* and 58*b* to download the suppressant gas concentration log.

The above-described portion of monitor unit 30 ensures that the existing fire suppression system's performance (at least in the vicinity of monitor unit 30) is sensed and recorded over its programmed initial-discharge and hold times. The output of concentration sensor 56 is also connected, however, through a logic circuit 60-65 having a second hold timer 64 that locks in a "continue-discharge" monitoring cycle during the suppression system's programmed hold time once the desired gas concentration is reached.

The output of concentration sensor 56 is delivered to adjustable high and low setpoint modules 60 and 62. High point module 60 sets a desired upper limit for suppressant gas concentration level, samples the signal from concentration sensor 56, and triggers when the setpoint is reached. The output of high point module 60 is read by logic modules 60*a* and 60*b*. Logic module 60*a* delivers a "0" logic signal to timer 64 until the setpoint is reached, after which module 60*a* changes state to start timer 64. Logic module 60*b* delivers a "+" logic signal to OR and AND gates 61,65 until the suppressant gas concentration setpoint is reached.

Low point module 62 sets a lower limit for the desired suppressant gas concentration level, below which discharge should be continued or renewed, and an associated logic module 62*a* reads the output from low point module 62 to switch between 0/+ states. The outputs of logic modules 62*a* and timer 64 are input to AND gate 63, whose output is coupled to one of the inputs of AND gate 65.

The outputs of the setpoint modules 60 and 62 and their associated logic modules and timer 64 are accordingly passed through OR and AND gates 61, 63, and 65 to turn relay module 66 on or off. The signal from the relay module is the "continue discharge" signal transmitted back to the main control panel. As long as a discharge signal is being received by OR gate 61 from card interface output 50*a*, the OR gate enables relay module 66. But the monitor unit's own sensor module 56 and logic circuit 60-65 establish an independent mechanism for enabling a "continue discharge" signal through relay 66 when the control panel's own discharge signal is off or interrupted. Setpoint modules 60 and 62 establish a range of desired suppressant gas concentration level as measured by sensor 56, above which the relayed "continue discharge" signal is turned off, below which the "continue discharge" signal is turned back on, and in between which the "continue discharge" signal is kept on.

A switch 64*a* between logic module 60*a* and timer 64 allows the timer to be disabled for testing purposes, for example where the test to be conducted is for a shorter period of time than the suppression system's hold time. Test mode switch 64*a* is preferably an internal switch, hidden behind the operator panel 47, for example being a key-operated switch incorporated into a circuit board containing the other monitor components.

Figure 5:
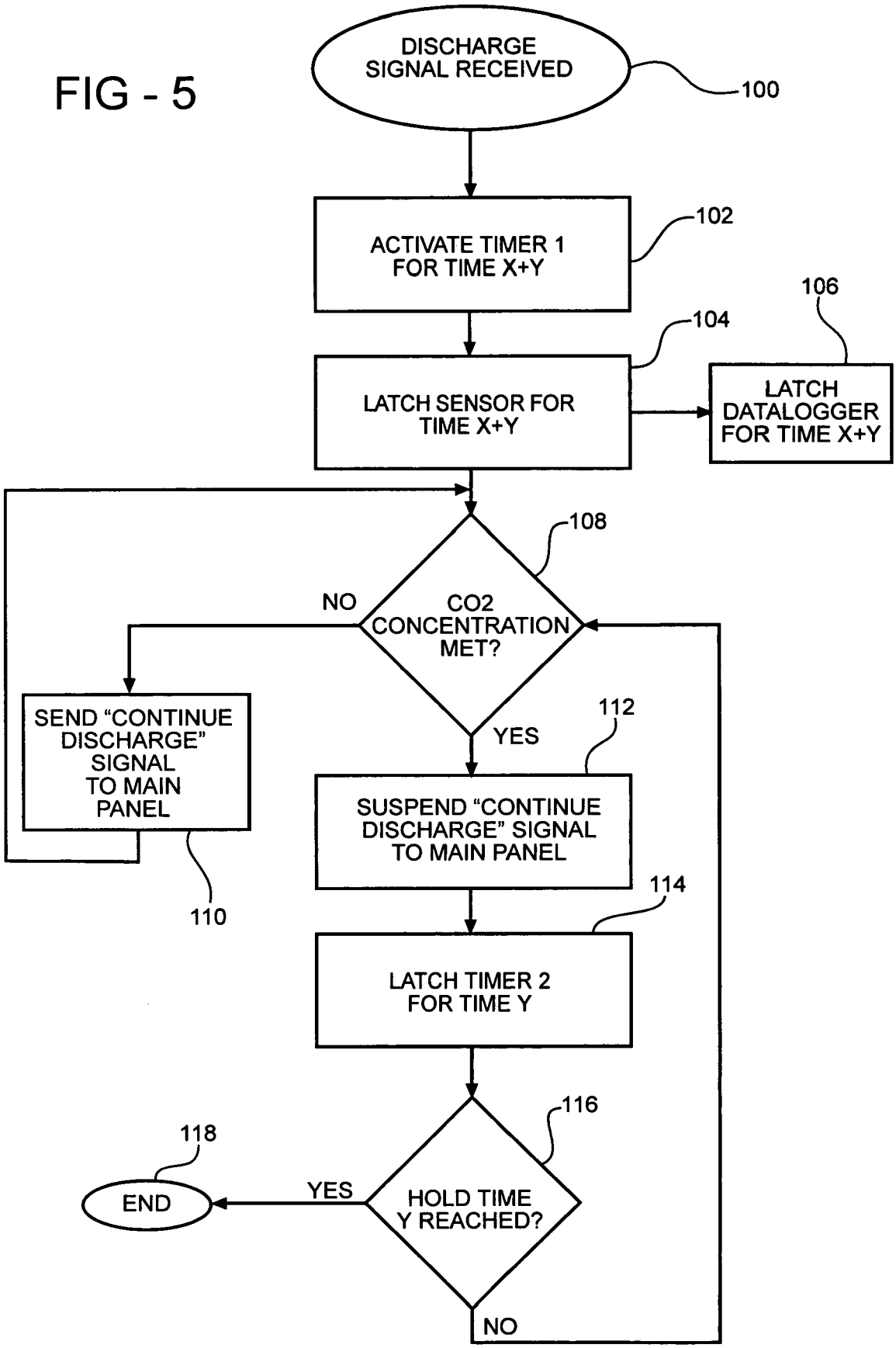
FIG. 5 is a flow chart of the preferred method of monitoring and prompting a fire suppression control system according to the invention.

FIG. 5 illustrates the method of monitoring and prompting the suppression system's performance carried out by the exemplary circuitry of FIG. 4. At step 100, the discharge signal is received from the fire suppression control system, for example system 10 in FIG. 2. At step 102, the first timer is activated for suppression system discharge time "x" (for example one minute) plus hold time "y" (for example twenty minutes). At steps 104 and 106 the concentration sensor and datalogger are latched "on" for the same amount of time, and begin monitoring and recording the results of the suppression system's discharge.

The monitor unit samples the suppressed environment's atmosphere at step 108 to measure suppressant gas concentration. If the specified suppression concentration has not been reached (for example, 35%), the system proceeds to step 110, where a "continue discharge" signal is returned to the suppression system's control panel to maintain the discharge. This loop continues until the specified concentration is met, at which point the system proceeds to step 112, suspending the "continue discharge" signal, and step 114, latching the second timer "on" for the suppression system's "y" hold time. The system now proceeds to step 116, where suppressant gas concentration is evaluated for the hold time, enabling the "continue discharge" signal as needed until the hold time runs out.

While it is theoretically possible, and highly desirable, that the suppression system will have enough suppressant gas storage to permit multiple discharges over the hold period if signaled by monitor unit 30, typical system storage will likely run dry before the hold time is out.

It will be understood by those skilled in the art that the method illustrated in FIG. 5 is not limited to the preferred example of a monitor apparatus as shown in FIGS. 2-4, and that the method is not limited to being performed by the preferred apparatus illustrated in FIG. 4.

Figure 6:
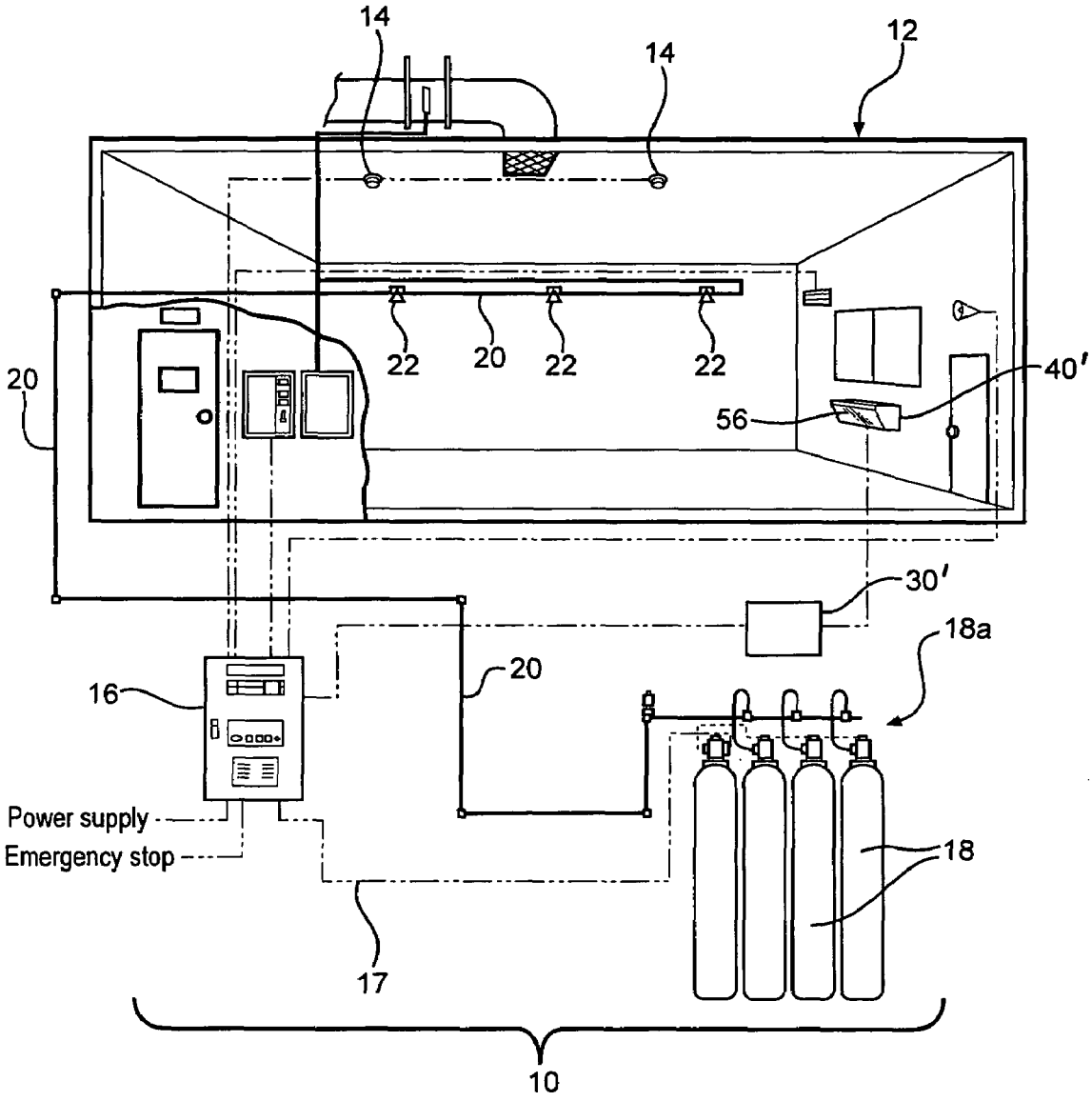
FIG. 6 is similar to FIG. 2, but shows an alternate embodiment of the invention in which the monitor unit's concentration sensor is located in the protected room, and the remainder of the monitor unit is located outside the room.
Figure 7:
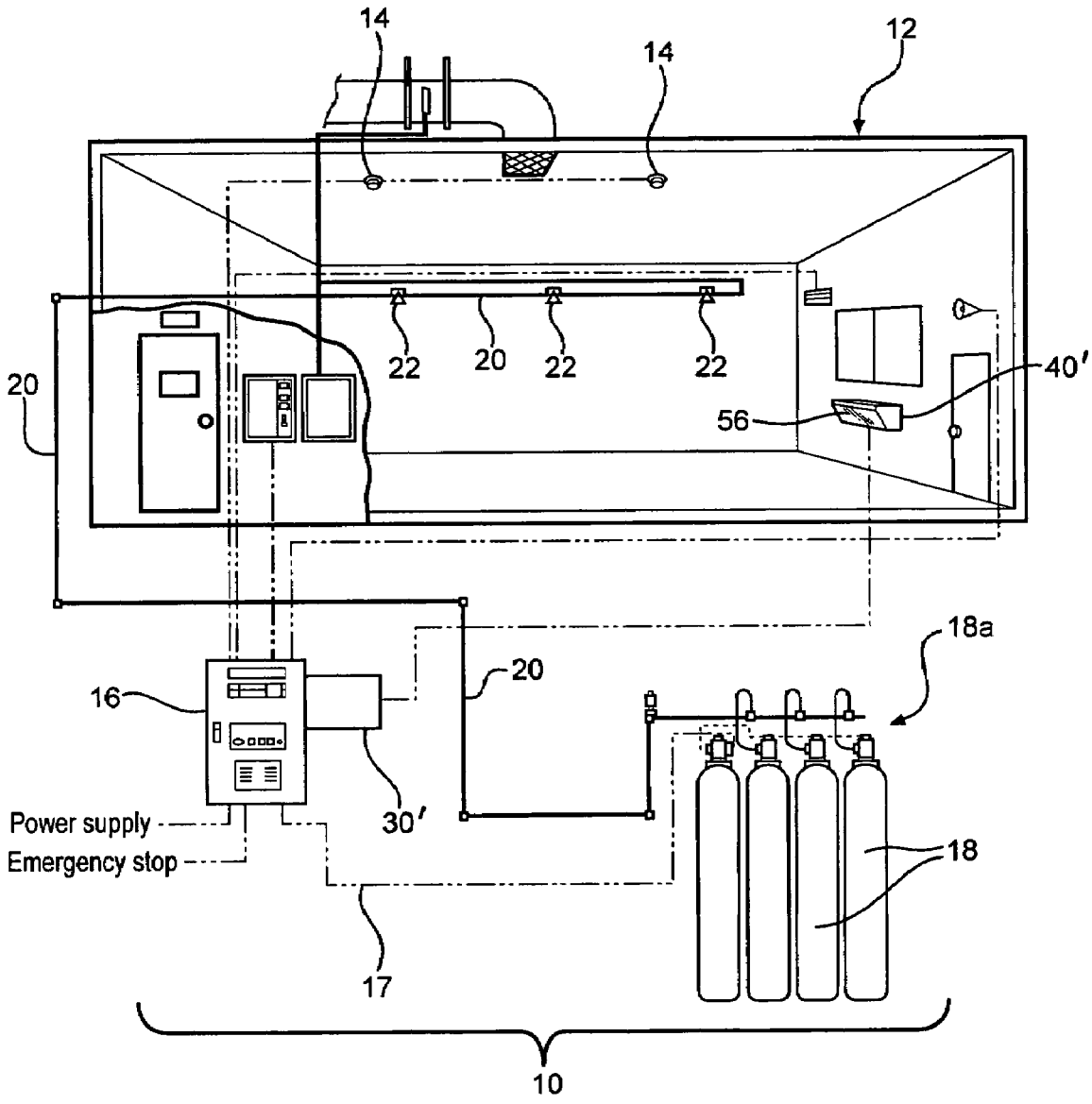
FIG. 7 is similar to FIG. 6, but shows another embodiment of the invention in which the remainder of the monitor unit is incorporated into the suppression system control panel.

It will also be understood that the preferred arrangement of monitor apparatus 30 in a unitary cabinet or housing as illustrated in FIGS. 2 and 3 can be modified. For example, FIG. 6 shows an alternate embodiment of the invention in which concentration sensor 56 is mounted in room 12, in a smaller, modified housing or cabinet 40' with an automatically released sensor cover as described above, while being connected to the remainder of monitor unit 30' located remotely from sensor 56, for example outside room 12. FIG. 7 shows yet another possible embodiment of the invention, in which the monitor unit components (except sensor 56) of FIG. 4 have been integrated with control panel 16 while concentration sensor 56 remains in room 12. It will be understood, however, that a physically independent monitor apparatus, whether by designated separate circuitry or components in the suppression system control panel or (preferred) in a housing physically separate from the control panel, is necessary for achieving the independent verification portion of the invention.

It will also be understood by those skilled in the art that while a single monitor unit 30 with a single concentration sensor is used to describe the invention, many installations will want or need more than one such unit and/or sensor at different locations around the area protected by the suppression system.

It will also be understood that although the invention is primarily intended for use with CO2 type fire suppression systems in enclosed areas, it may also be useful for certain types of non-enclosed environments (often referred to as "spot hazards") that are protected by CO2 type fire suppression systems.

It will therefore be understood that the disclosed embodiments are representative of presently preferred forms of the invention, but are intended to be illustrative rather than definitive of the invention. The scope of the invention is defined by the following claims.

I accordingly claim:

1. A monitor apparatus for use with a suppressant gas type fire suppression system, the fire suppression system having a controller that delivers a discharge signal to discharge suppressant gas from a suppressant gas delivery system into a protected environment in response to a fire signal, the monitor apparatus comprising:

a connection for receiving a discharge signal from the fire suppression system during a full-discharge test or actual fire;

a suppressant gas concentration sensor communicating with the monitor apparatus independently of the fire suppression system, the suppressant gas concentration sensor located in the protected environment for sensing a concentration of the gas delivered by the fire suppression system into the protected environment during the full-discharge test or actual fire;

recording means for recording readings from the gas concentration sensor over a period of time corresponding to a discharge-to-concentration time plus a hold time of the fire suppression system during the full-discharge test or actual fire;

discharge prompting means for monitoring the gas concentration sensor independently of the fire suppression system and for generating a continue-discharge signal distinct from the discharge signal of the fire suppression system in response to a low suppressant gas concentration reading by the concentration sensor during the full-discharge test or actual fire, and a connection for delivering the continue-discharge signal to the fire suppression system during the full-discharge test or actual fire.

2. The monitor apparatus of claim 1, further including timer means for latching the discharge prompting means on for the fire suppression system's hold time.

3. The monitor apparatus of claim 2, wherein the timer means is responsive to a desired suppressant gas concentration level being sensed by the sensor.

4. The monitor apparatus of claim 2, further including a second timer means associated with the concentration sensor and the recording means for latching the concentration sensor and the recording means on for the the discharge-to-concentration time plus the hold time.

5. The monitor apparatus of claim 1, wherein the suppressant gas concentration sensor is a direct suppressant gas sensor that directly senses the concentration of the suppressant gas.

6. The monitor apparatus of claim 1, wherein the suppressant gas concentration sensor is an indirect suppressant gas concentration sensor that indirectly senses the concentration of suppressant gas.

7. The monitor apparatus of claim 1, wherein the monitor apparatus is located in the protected environment into which the fire suppression system delivers the suppressant gas.

8. The monitor apparatus of claim 7, wherein the monitor apparatus is a unit contained in a single housing.

9. The monitor apparatus of claim 8, wherein the monitor apparatus includes its own power supply in the housing.

10. The monitor apparatus of claim 8, wherein the monitor apparatus housing comprises an enclosed cabinet with a cover over the concentration sensor, the cover being responsive to the discharge signal from the fire suppression system to automatically open to expose the sensor to the enclosed environment.

11. The monitor apparatus of claim 1, wherein the concentration sensor is located separately from the recording means and discharge prompting means.

12. The monitor apparatus of claim 11, wherein the concentration sensor is located in the protected environment and the recording means and discharge prompting means are located outside the protected environment.

13. The monitor apparatus of claim 12, wherein the recording means and discharge prompting means are integrated with the suppression system controller.

14. The apparatus of claim 1, wherein the protected environment comprises a non-enclosed environment around a spot hazard.

15. A monitor apparatus for monitoring, verifying, and prompting the performance of a suppressant gas type fire suppression system associated with a protected environment, the fire suppression system comprising a controller that delivers a discharge signal to discharge suppressant gas from a suppressant gas delivery system into a protected environment in response to a fire signal, the monitor apparatus comprising a stand-alone unit independent of the fire suppression system and located within the protected environment, the unit comprising its own gas concentration sensor, the unit comprising means for generating a log of the concentration sensor readings during a full-discharge test or actual fire, the unit comprising a signal connection to the fire suppression system for receiving a discharge signal from the fire suppression system during the full-discharge test or actual fire to enable the sensor to monitor concentration levels of suppressant gas discharged by the fire suppression system into the protected environment during the full-discharge test or actual fire, and the unit further comprising a signal connection to the fire suppression system for delivering a continue-discharge signal distinct from the discharge signal of the fire suppression system to the fire suppression system during the full-discharge test or actual fire when sensed levels of the suppressant gas are not reached or held per the fire suppression system's own requirements during the full-discharge test or actual fire.

16. The apparatus of claim 15, wherein the protected environment comprises a non-enclosed environment around a spot hazard.

17. A method for monitoring, verifying, and prompting the performance of a suppressant gas type fire suppression system associated with a protected environment, the fire suppression system delivering a discharge signal to discharge suppressant gas from a suppressant gas delivery system into a protected environment in response to a fire signal, comprising the steps of:

placing a monitor unit in the protected environment, the monitor unit comprising its own gas concentration sensor and a signal connection to the fire suppression system;

activating the monitor unit with a discharge signal from the fire suppression system during a full-discharge test or actual fire;

recording suppressant gas concentration levels in the protected environment during the full-discharge test or actual fire using the gas concentration sensor in the monitor;

delivering a continue-discharge signal distinct from the discharge signal of the fire suppression system from the monitor unit to the fire suppression system during the full-discharge test or actual fire when suppressant gas concentration levels fall below a desired level as measured by the monitor unit's gas concentration sensor during the full-discharge test or actual fire.

18. The method of claim 17, further including the steps of suspending the continue-discharge signal after the sensor indicates that the desired suppressant gas concentration level has been reached, and further enabling the monitor unit for a period of time corresponding to a fire suppression system hold time to renew the continue-discharge signal if the desired suppressant gas concentration level falls back below the desired level.

19. The method of claim 18, further including the step of limiting the period of time during which the monitor unit is enabled to renew the continue-discharge signal to the fire suppression system hold time.

20. The method of claim 15, wherein the protected environment comprises a non-enclosed environment around a spot hazard.

21. A method for monitoring, verifying, and prompting the performance of a suppressant gas type fire suppression system associated with a protected environment, the fire suppression system delivering a discharge signal to discharge suppressant gas from a suppressant gas delivery system into a protected environment in response to a fire signal, comprising the steps of:

providing a monitor, the monitor comprising a gas concentration sensor in the protected environment and a signal connection to the fire suppression system;

activating the monitor with a discharge signal from the fire suppression system during a full-discharge test or actual fire;

recording suppressant gas concentration levels in the protected environment during the full-discharge test or actual fire using the gas concentration sensor;

delivering a continue-discharge signal distinct from the discharge signal of the fire suppression system from the monitor to the fire suppression system during the full-discharge test or actual fire when suppressant gas concentration levels fall below a desired level as measured by the monitor's gas concentration sensor during the full-discharge test or actual fire.

* * * * *

UNITED STATES PATENT AND TRADEMARK OFFICE

CERTIFICATE OF CORRECTION

PATENT NO. : 7,775,292 B1
APPLICATION NO. : 10/898883
DATED : August 17, 2010
INVENTOR(S) : Ernest K. Romanco It is certified that error appears in the above-identified patent and that said Letters Patent is hereby corrected as shown below:

column 10, line 20 (first line of claim 20): “15” should be amended to --17--.

Signed and Sealed this
Twenty-sixth Day of July, 2011

David J. Kappos

David J. Kappos
*Director of the United States Patent and Trademark Office*